US005730278A

United States Patent [19]

Baba et al.

[11] Patent Number: 5,730,278

[45] Date of Patent: Mar. 24, 1998

[54] TRANSFER FEEDER

[75] Inventors: Kiyokazu Baba; Masaaki Ogawa, both of Komatsu, Japan

[73] Assignee: Kabushiki Kaisha Komatsu, Seisakusho, Tokyo, Japan

[21] Appl. No.: 492,094

[22] PCT Filed: Jan. 20, 1994

[86] PCT No.: PCT/JP94/00074

§ 371 Date: Jun. 29, 1995

§ 102(e) Date: Jun. 29, 1995

[87] PCT Pub. No.: WO94/16840

PCT Pub. Date: Aug. 4, 1994

[30] Foreign Application Priority Data

Jan. 21, 1993 [JP] Japan ..... 5-008205
Jan. 21, 1993 [JP] Japan ..... 5-008220

[51] Int. Cl.[6] ..... B65G 25/00

[52] U.S. Cl. ..... 198/621.1; 198/774.3

[58] Field of Search ..... 198/621.1, 621.2, 198/774.3

[56] References Cited

U.S. PATENT DOCUMENTS

| | | | |
|---|---|---|---|
| 4,540,087 | 9/1985 | Mizumoto . | |
| 4,555,012 | 11/1985 | Baba et al. | 198/621.1 |
| 4,674,624 | 6/1987 | Katoh | 198/621.1 |
| 4,823,587 | 4/1989 | Wolfgang et al. | 198/621.1 X |
| 4,981,031 | 1/1991 | Schneider et al. | 198/621.1 X |
| 5,001,921 | 3/1991 | Schneider et al. | 198/621.1 X |
| 5,269,168 | 12/1993 | Ogawa | 198/621.1 X |

FOREIGN PATENT DOCUMENTS

| | | |
|---|---|---|
| 3905068 A1 | 8/1990 | Germany . |
| 3905073 A1 | 8/1990 | Germany . |
| 3913663 A1 | 10/1990 | Germany . |
| 4110215 A1 | 10/1992 | Germany . |
| 4237313 A1 | 5/1994 | Germany . |
| 56-126144 | 10/1981 | Japan . |
| 63-47525 | 9/1988 | Japan . |
| 1-37784 | 11/1989 | Japan . |

*Primary Examiner*—D. Glenn Dayoan
*Attorney, Agent, or Firm*—Frishauf, Holtz, Goodman, Langer & Chick

[57] ABSTRACT

A transfer feeder for a module-type transfer press, wherein the module-type transfer press includes a plurality of slides, a crown having a plurality of crown portions for each of the respective slides, and respective slide drive mechanisms accommodated in each of the crown portions for driving the respective slides. The transfer feeder includes a lift drive mechanism and a feed drive mechanism disposed in an upper portion of the transfer press. The lift drive mechanism is driven by a lift drive source. The feed drive mechanism is accommodated in an upstream one of the crown portions which is disposed on an upstream side of the transfer press, and is driven by power derived from the slide drive mechanism accommodated in the upstream one of the crown portions.

6 Claims, 10 Drawing Sheets

TRANSFER FEEDER

TECHNICAL FIELD

The present invention relates to a transfer feeder provided for a transfer press.

BACKGROUND ART

In general, a transfer press is provided with a transfer feeder for conveying a work.

Conventional transfer feeders include one of the type in which a pair of transfer bars arranged side by side along a workpiece conveying direction are operated in three-dimensional direction, and the work is conveyed under a condition clamped by fingers disposed at positions opposed to the respective transfer bars, and another one of the type in which cross bars provided with work sucking or attracting means are mounted between the respective transfer bars, and the transfer bars are operated in two-dimensional direction to thereby convey the work.

However, in both types of the conventional transfer feeder, a driving power taken out of a press body is transmitted to a cam shaft in a cam box disposed below the transfer bars, and the two- or three-dimensional driving power is obtained by a cam mounted on the cam shaft and a lever, thereby driving the transfer bars.

As mentioned above, the conventional transfer feeders each have a structure such that the driving power is taken out of a crown portion disposed to an upper portion of the press body and then transmitted to a lower portion of the press body through the power take-out shaft. Accordingly, many members such as bevel gears are required to be disposed in a driving system, which may result in a backlash is caused due to the location of the bevel gears, for example, causing a vibration of the transfer bars and hence causing a misfeed of the work.

Furthermore, in the conventional transfer feeders, since the cam box is disposed below the transfer bars, it is necessary to form a wide pit below the press body, resulting in increased cost.

Still furthermore, in the conventional transfer feeders, it is difficult to visually observe the inside of the press body by the location of the cam box below the transfer bars, and when a worker works in the press body, it becomes difficult to enter the press body, thus causing inconvenience.

Still furthermore, in the conventional transfer feeders, the transfer bars are supported at two points of their upstream and downstream sides, so that a span between the supporting points is made long and, accordingly, it is required to use transfer bars having a high rigidity. Thus, the weight thereof increases, and hence, a lift drive mechanism for handling the transfer bars is made large and expensive, and more inconvenient.

This invention was conceived for resolving the above inconvenience and has an object of providing a transfer feeder in which a driving system is simple, a location is easy, which makes it easy to visually observe the inside of the press body, and which enables a lift drive mechanism to be small and made at a low cost.

DISCLOSURE OF THE INVENTION

The transfer feeder of the present invention was conceived in view of the above matters, and one embodiment of the present invention for achieving this and other objects provides a transfer feeder of a module-type transfer press in which a plurality of slides are disposed, a crown is divided into a plurality of crown portions for the slides, respectively, and slide drive mechanisms for driving the slides are accommodated in the crown portions, the transfer feeder being characterized in that a lift drive mechanism and a feed drive mechanism which is accommodated in a crown portion disposed on an upstream side are provided to an upper portion of a press body of the transfer press.

According to this structure, since the lift drive mechanism and the feed drive mechanism are disposed to the upper portion of the press body and the feed drive mechanism is accommodated in the upstream side crown portion, it is not necessary to locate any driving system for taking out a power between the slide drive mechanisms and the feed drive mechanism. Consequently, the misfeed to be caused by the vibration of the cross-bar due to the backlash caused in the driving system can be prevented from occurring, and it is also not necessary to locate a cam box for the accommodation of the feed drive mechanism, thereby reducing cost.

Furthermore, since no cam box or the like exists at a portion on the eye level of an operator, the visual field of the operator inside the press body can be improved, and in addition, the operator can easily enter the press body for working therein, thus improving workability.

In another embodiment, there is provided a transfer feeder of a module-type transfer press in which a plurality of slides are disposed, a crown is divided into a plurality of crown portions for the slides, respectively, and slide drive mechanisms for driving the slides are accommodated in the crown portions, the transfer feeder being characterized in that a lift drive mechanism and a feed drive mechanism driven by a power taken out from the slide drive mechanism.

According to this structure, since the lift drive mechanism and the feed drive mechanism are disposed to the upper portion of the press body, a transmission line of the driving system for transmitting the power taken out of the slide drive mechanism to the feed drive mechanism is made short, thereby providing a simple structure for the driving system. Consequently, the misfeed to be caused by the vibration of the cross-bar due to the backlash caused in the driving system can be prevented from occurring, and it is also not necessary to locate a cam box for the accommodation of the feed drive mechanism, thereby reducing cost.

Furthermore, since no cam box or the like exists at a portion on the eye level of an operator, the visual field of the operator inside the press body can be improved, and in addition, the operator can easily enter the press body for the working therein, thus improving the workability.

In addition to the above structural features, according to the present invention, lift beams disposed side by side in the press body along a work conveying direction and the lift beam is driven in a lift direction by the lift drive mechanism through a plurality of lift rods arranged between the respective slides.

According to this structure, since the lift beam is supported by the plural lift rods at the plural support points, the vertical vibration of the lift beam can be suppressed and the rigidity of the lift beam can thus be made small, so that the weight of the lift beam is reduced and the lift drive mechanism can hence be made small in size.

Furthermore, in addition to the above structural features, a plurality of cross-bar carriers between which cross-bars are mounted are supported to be movable in the work conveying direction by the lift beam and the cross-bar carriers are driven in the feed direction by the feed drive mechanism through a feed lever.

Still furthermore, a servo-motor is employed as a driving source of the lift drive mechanism.

According to this structure, the lift drive mechanism employs the servo-drive mechanism, and the lift stroke and the motion pattern can be optionally changed, so that the present invention is easily applicable to works having various shape.

BRIEF DESCRIPTION OF THE DRAWINGS

The present invention will become more understandable from the following detailed description and accompanying drawings representing embodiments of the present invention. Further, it is to be noted that the embodiments shown in the accompanying drawings do not intend to specify the invention and merely intend to make easy the understanding of the invention.

BEST MODE FOR EMBODYING THE INVENTION

Hereunder, one embodiment which is applied to a module-type transfer press, in which crown portions are disposed independently for slides, respectively, will be described in detail with reference to FIGS. 1 to 6.

Figure 1:
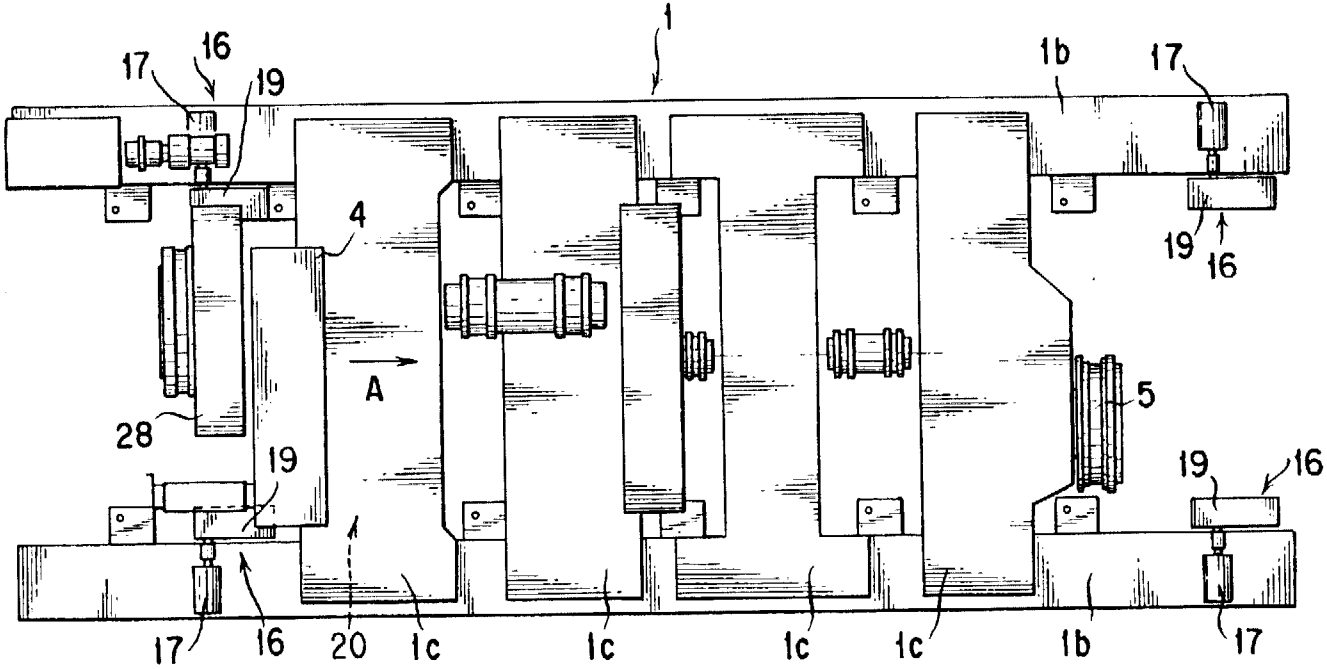
FIG. 1 is a plan view of a transfer press provided with a transfer feeder according to one embodiment of the present invention.
Figure 2:
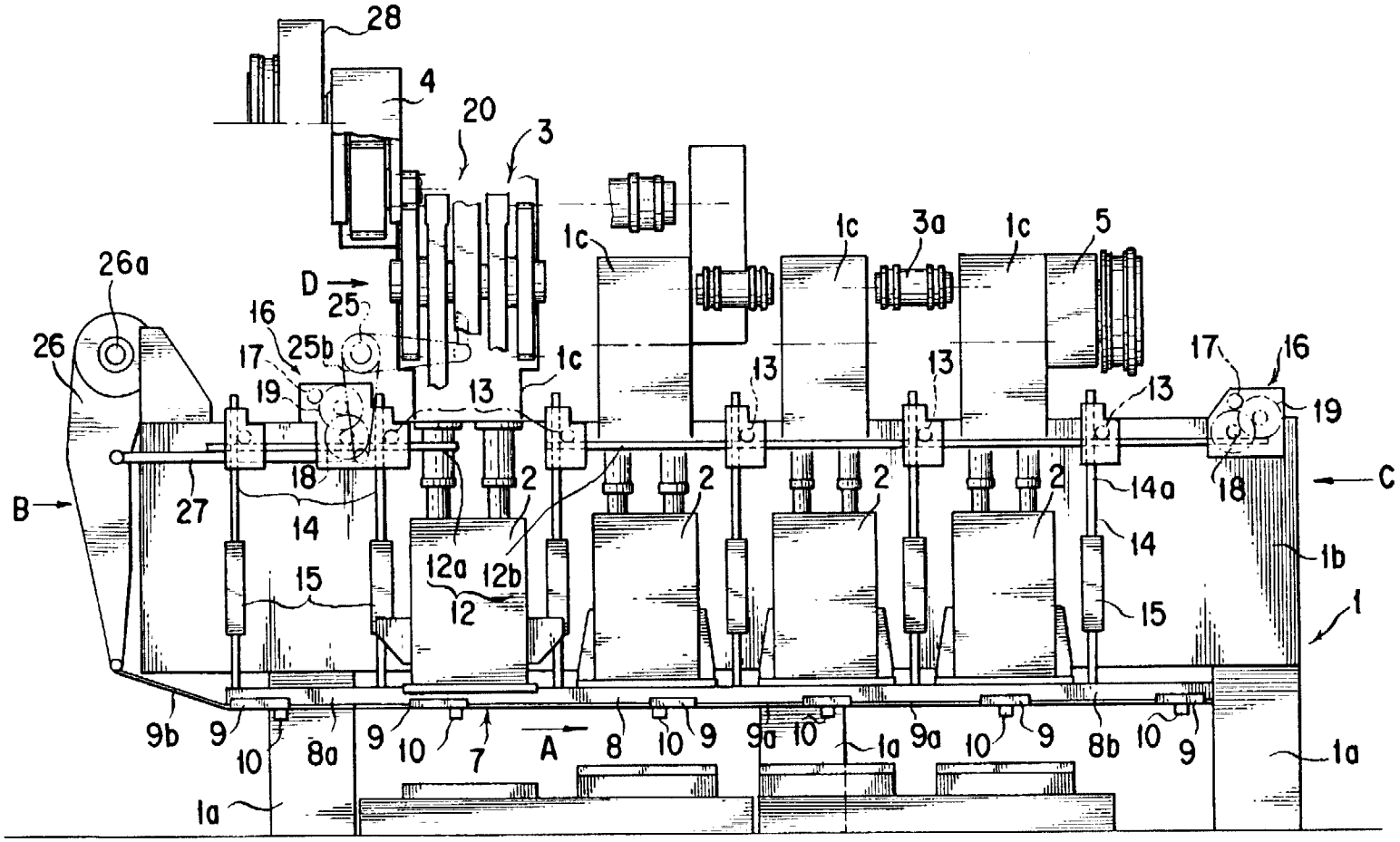
FIG. 2 is a front view of the transfer press shown in FIG. 1.
Figure 3:
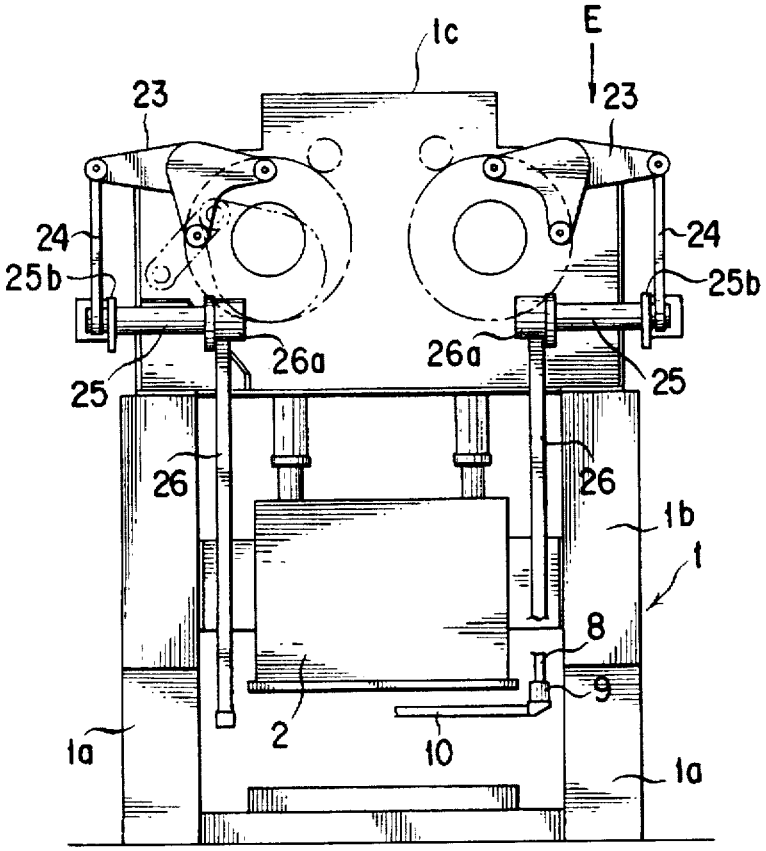
FIG. 3 is a view arrowed in a direction B in FIG. 2.
Figure 4:
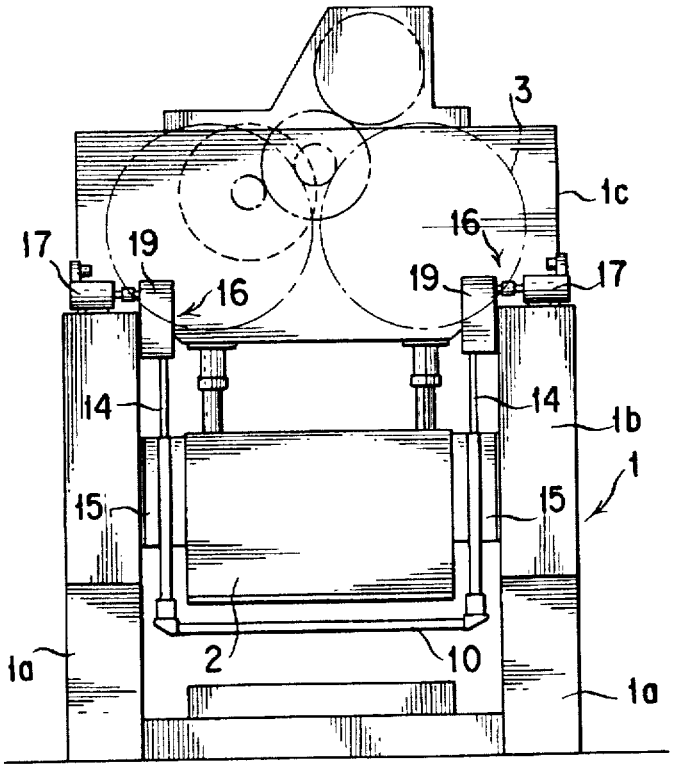
FIG. 4 is a view arrowed in a direction C in FIG. 2.

FIG. 1 is a plan view of a transfer press in which one embodiment of a transfer feeder is provided, FIG. 2 is a front view thereof, FIG. 3 is a view from a direction of an arrow B in FIG. 2, and FIG. 4 is a view from a direction of an arrow C in FIG. 2.

In these drawings, reference numeral 1 denotes a press body, in which a pair of beams 1*b* are horizontally provided with a distance at front and rear portions between the upper end portions of respective three uprights 1*a* disposed to front and rear portions with distances therebetween. A plurality of slides 2 are disposed between these beams 1*b*, and a plurality of crown portions 1*c* are provided for the slides 2, respectively independently.

In each of the crown portions 1*c*, there is accommodated a slide drive mechanism 3, by which each slide 2 is vertically driven. The slide drive mechanism 3 in one crown 1*c* and another slide drive mechanism in another crown portion 1*c* disposed adjacent to that one crown portion 1*c* are connected through an interlocking shaft 3*a*. An interlocking shaft 3*a* disposed to the most upstream side is connected to a main motor 28 through a clutch 4, and a brake 5 is arranged on a side surface of the downstream side crown portion 1*c*.

In the figures, reference numeral 7 denotes a transfer feeder, in which a pair of lift beams 8, divided into upstream side and downstream side portions, are provided side by side so as to extend in a workpiece conveying direction A. A plurality of cross-bar carriers 9 are supported by the lift beams 8 with constant pitch to be movable in the workpiece conveying direction A.

The adjacent cross-bar carriers 9 are connected together by means of a connection rod 9*a* so that all the cross-bar carriers 9 are moved at the same time in the work conveying direction. Cross-bars 10 are horizontally provided between the opposing cross-bar carriers 9, and vacuum cups (not shown) for sucking or attracting the work are attached to the cross-bars 10.

A lift rack 12 divided into upstream side and downstream side portions is supported above the lift beams 8 to be movable in the work conveying direction A, and for example, two pinions 13 and four pinions 13 are engaged with the upstream side lift rack 12*a* and the downstream side lift rack 12*b*, respectively.

These pinions 13 are located between the respective slides 2 and also engaged with racks 14*a* formed to a plurality of lift rods 14 disposed between the respective slides 2.

Each of the lift rods 14 is arranged to be vertically movable through guidance of a guide 15 mounted to a beam 1*b* of the press body 1. The upstream side lift beam 8*a* is secured between the lower ends of the two lift rods 14 disposed upstream side and the downstream side lift beam 8*b* is secured between the lower ends of the lift rods 14 disposed downstream side, the lift beam 8 being supported at plural points by these lift rods 14.

Lift drive mechanisms 16 are provided on the upstream and downstream sides of the beam 1*b* of the press body 1.

The lift drive mechanisms 16 are equipped with servo-motors 17, to which pinions 18 engaged with the upstream side lift rack 12*a* and the downstream side lift rack 12*b* are connected through speed reduction mechanisms 19, respectively, so that the respective lift racks 12*a* and 12*b* are driven simultaneously or independently by the operation of the servo-motors 17.

A feed drive mechanism 20 is accommodated in the crown portion 1*c* disposed on the most upstream side of the press body 1.

Figure 5:
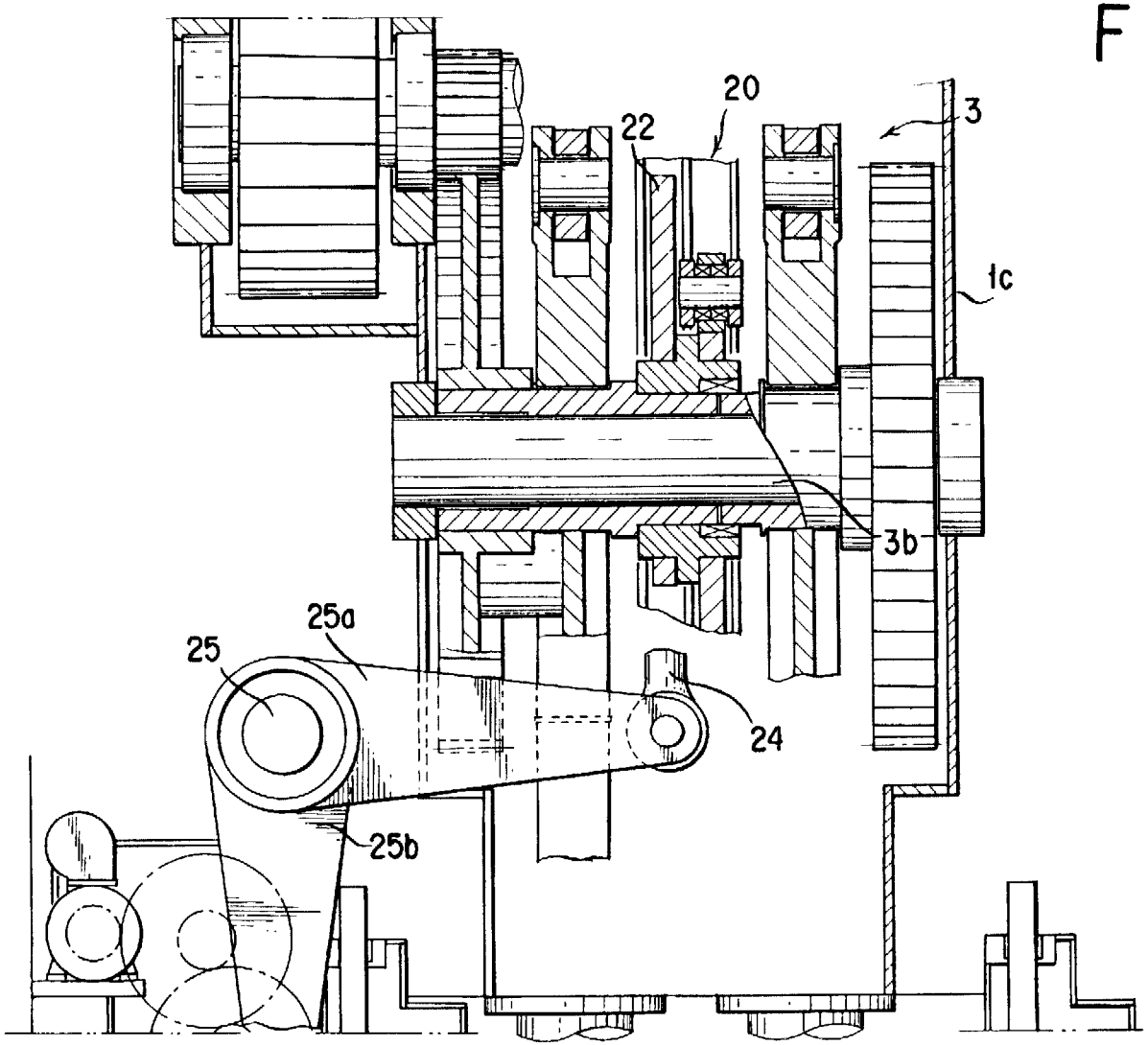
FIG. 5 is an enlarged view of a portion D in FIG. 2.

The feed drive mechanism 20 is provided, as shown in FIG. 5, with a feed cam 22 formed as a positive cam and mounted on a driving shaft 3*b* of each of the slide drive mechanisms 3 disposed in the upstream side crown portion 1*c*.

One end of a swing lever 23 supported at its intermediate portion abuts against each of the feed cams 22 through a cam follower 23*a* and the other end of the swing lever 23 is connected to a front end of a lever 25*a* provided to one end of a shaft 25 through an upper end portion of a transmission link 24.

Figure 6:
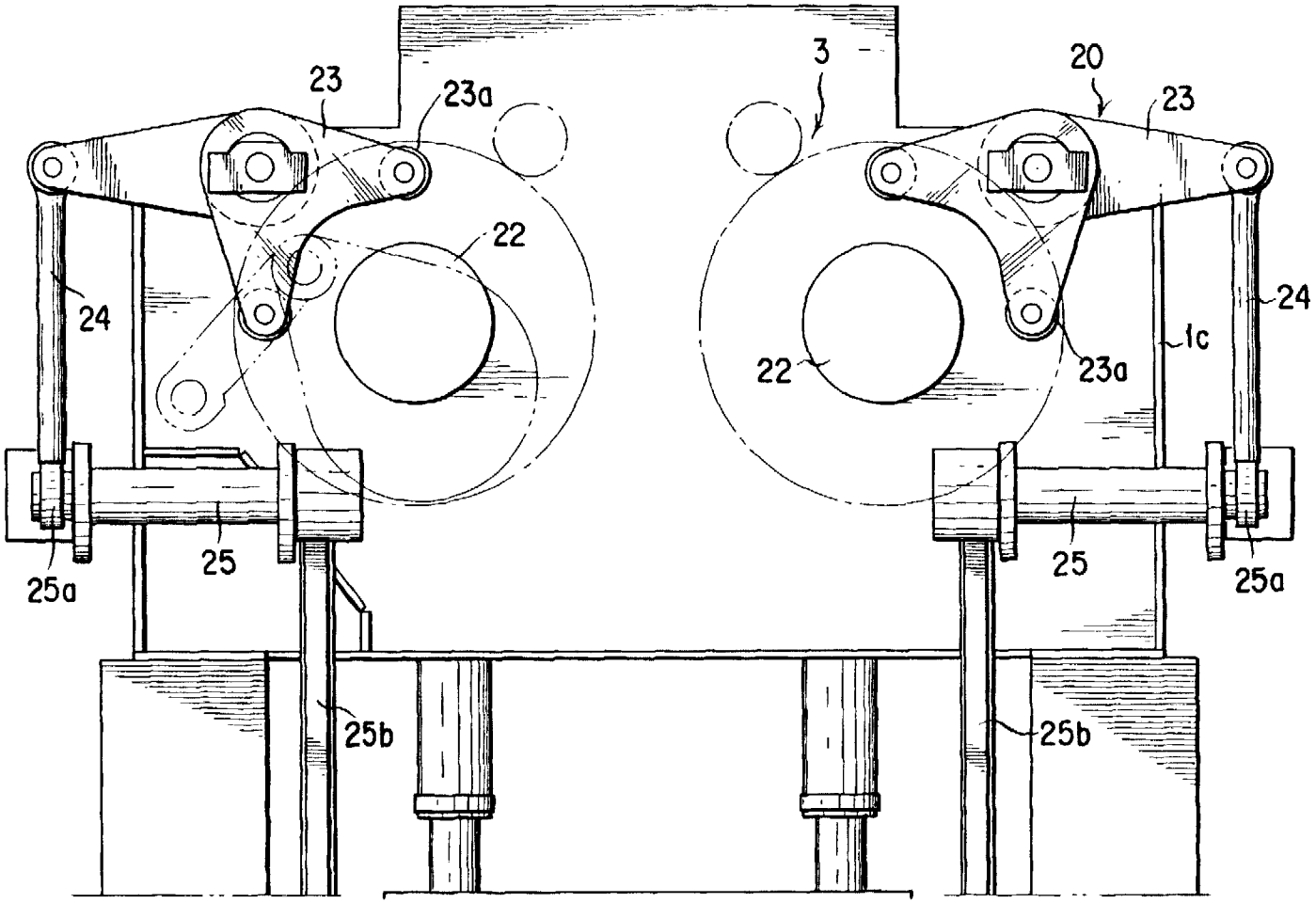
FIG. 6 is an enlarged view of a portion E in FIG. 3.

The shaft 25 is, as shown in FIG. 3, divided bilaterally and supported horizontally on the upstream side of the press body 1. As shown in FIG. 6, another lever 25*b* disposed on the other end side and a feed lever 26 are interlocked through a connection link 27, and the cross-bar carrier 9 disposed on the most upstream side is connected to the front end of the feed lever 26 through the connection rod 9*b*.

The operation of the transfer feeder described above will be explained hereunder.

When the upstream side slide drive mechanism 3 is driven by means of the main motor 28, the downstream side slide drive mechanism 3 connected through the interlocking shaft 3*a* is also driven at the same time, thereby vertically moving the respective slides 2 to carry out pressing work in respective working stations.

In accordance with the rotation of the feed cam 22 mounted to the driving shaft 3b of the slide driving mechanism 3, the levers 25a and 25b are rotated about the shaft 25 through the swing lever 23 and the transmission link 24, and then, the feed lever 26 is rotated about the shaft 26a through the connection link 27, whereby the cross-bar carriers 9 supported by the lift beam 8 are driven in the feed direction.

Then, the lift racks 12 are driven, through the speed reduction mechanisms 19, by the operation of the servo-motors 17 of the lift drive mechanisms 16 controlled in synchronism with the operation of the press body 1, whereby the lift beam 8 is moved vertically through the respective lift rods 14, so that the cross-bars 10 horizontally disposed between the respective cross-bar carriers 9 are driven in the feed and lift directions, and the workpiece sucked by the vacuum cup, not shown, are conveyed successively to the working stations.

Further, in the embodiment described above, although the upstream side lift beam 8a and the downstream side lift beam 8b are lifted at the same time with the same lifting amount, it may be possible to lift these lift beams 8a and 8b with different lifting amounts because these lift beams 8a and 8b are provided with the respectively independent lift drive mechanisms 16.

In the embodiment, as described in detail, the feed drive mechanism 20 and the lift drive mechanism 16 are disposed to the upper portion of the press body 1 and the feed drive mechanism 20 is accommodated in the upstream side crown portion 1c, so that it is not necessary to locate any driving system for taking out a driving power between the slide drive mechanism 3 and the feed drive mechanism 20.

According to the described structure, the miss-feed of the workpiece which may be caused by the vibration of the cross-bars 10 due to the backlash caused in the driving system can be prevented, and in addition, it is not necessary to locate a cam box for accommodating the feed drive mechanism 20, thus reducing the product cost.

Furthermore, since the lift beam 8 is supported by the plural lift rods 14 at the plural points, the vertical vibration thereof can be suppressed, and the rigidity of the lift beam 8 can be made small, so that the weight of the lift beam 8 can be reduced, and hence, the lift drive mechanism 16 for driving the lift beam 8 can also make small in size. In addition, since the lift stroke and the motion pattern can be optionally changed by the application of the servo-drive structure to the lift drive mechanism 16, the present invention is easily applicable to works having various shapes.

Still furthermore, since the cam box or the like does not exist at a portion at the eye level of an operator, the inside of the press body 1 becomes more visual and the operator can easily enter the press body.

Another embodiment of the transfer feeder according to the present invention will be described hereunder with reference to FIGS. 7 to 10.

Figure 7:
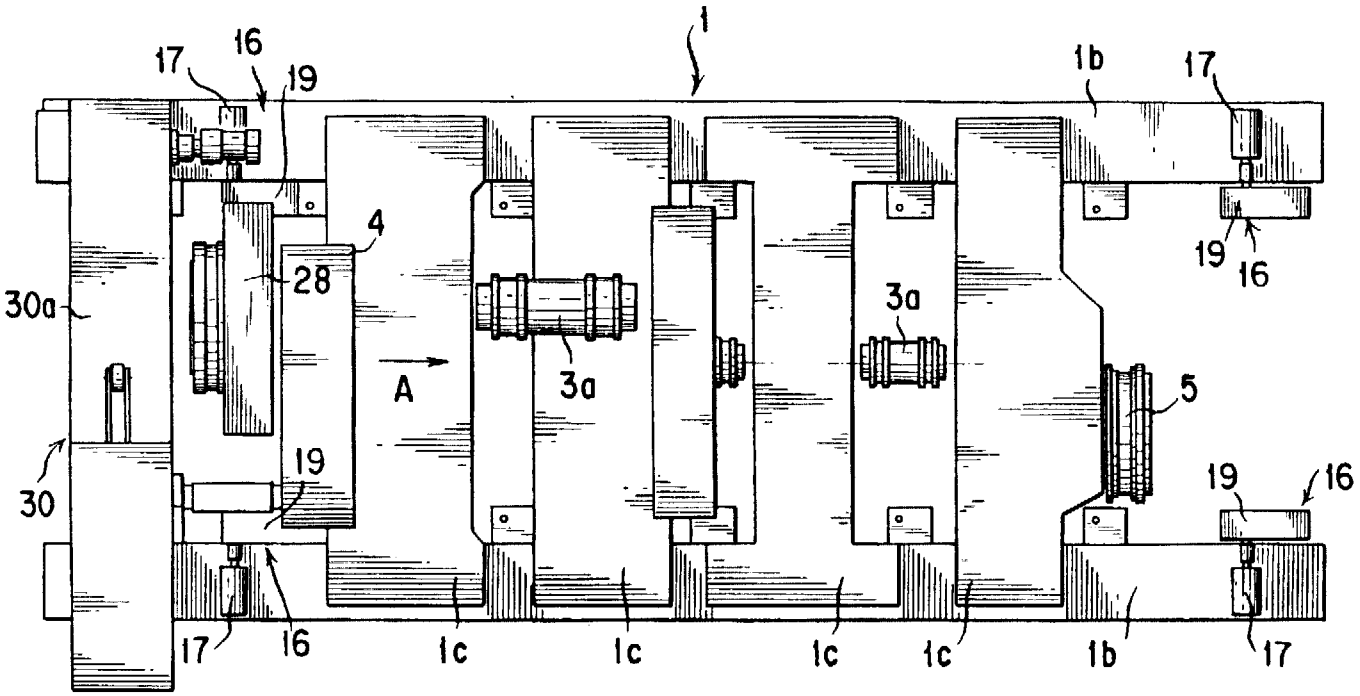
FIG. 7 is a plan view of a transfer press provided with a transfer feeder according to another embodiment of the present invention.
Figure 8:
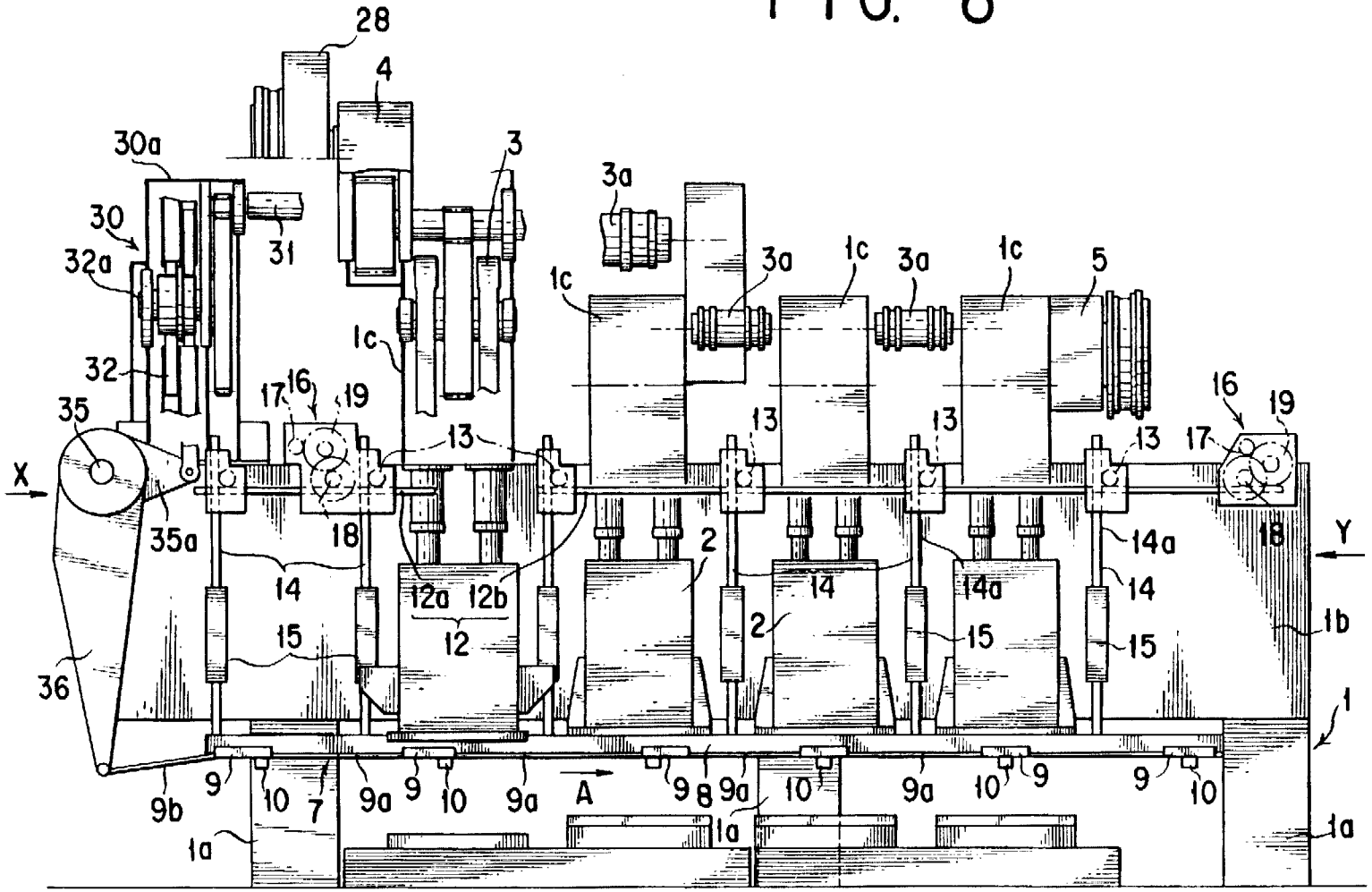
FIG. 8 is a front view of the transfer press shown in FIG. 7.
Figure 9:
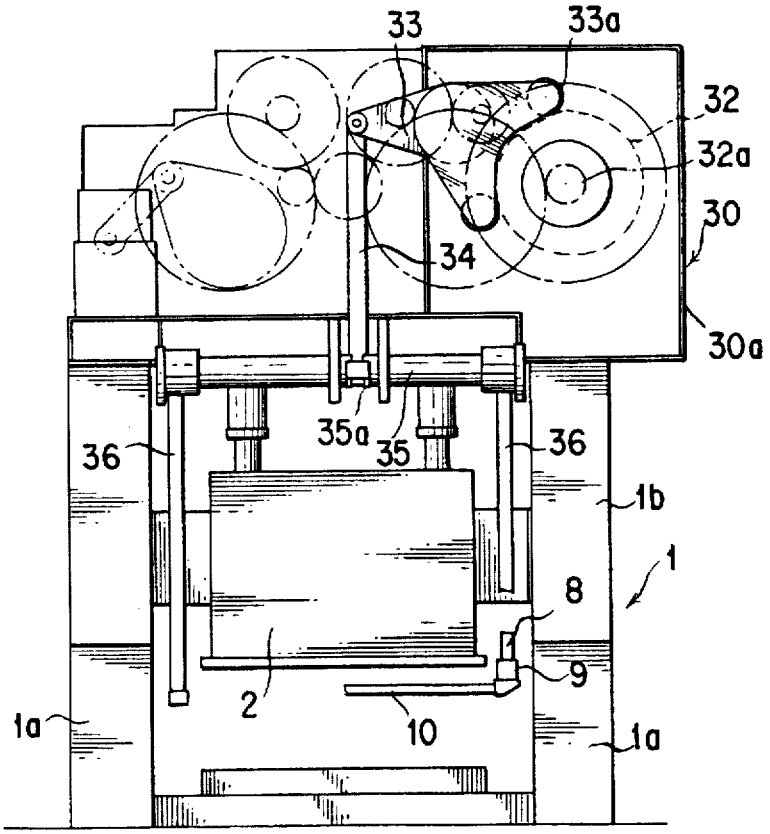
FIG. 9 is a view arrowed in a direction X in FIG. 8.
Figure 10:
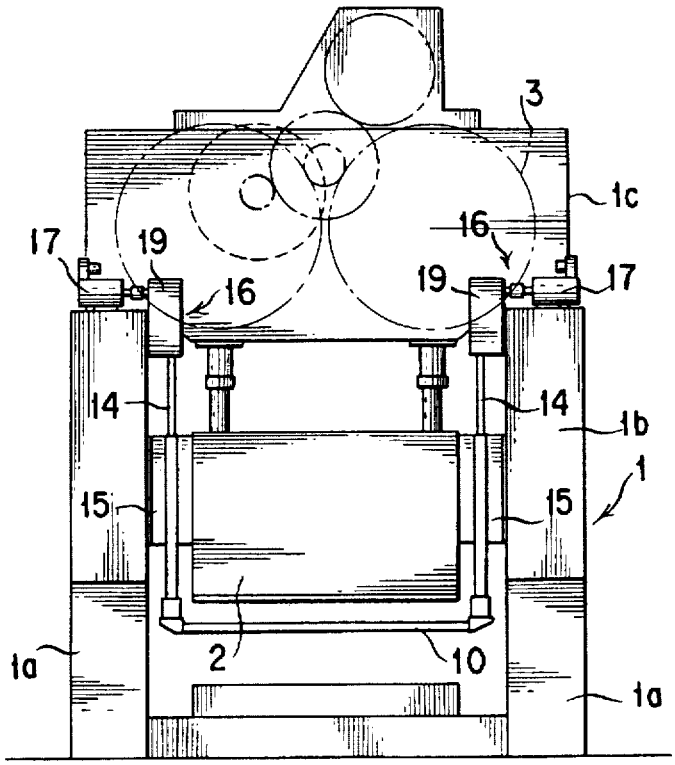
FIG. 10 is a view arrowed in a direction Y in FIG. 8.

FIG. 7 is a plan view of a transfer press in which another embodiment of a transfer feeder of the present invention is provided, FIG. 8 is a front view thereof, FIG. 9 is a view in a direction of an arrow X in FIG. 8, and FIG. 10 is a view in a direction of an arrow Y in FIG. 8.

The transfer feeder of this embodiment is provided with substantially the same structure as that of the former embodiment except for the feed drive mechanism, so that the description of the structure other than the feed drive mechanism is omitted herein.

In this embodiment, a feed drive mechanism 30 is disposed to the upper portion on the upstream side of the press body 1.

The feed drive mechanism 30 has a cam box 30a in which is disposed a cam shaft 32a driven by the upstream side slide drive mechanism 3 through a power take-out shaft 31, and a feed cam 32 formed as positive cam is mounted to the cam shaft 32a.

One end of a swing lever 33 supported at its intermediate portion abuts against each of the feed cams 32 through a cam follower 33a and the other end of the swing lever 33 is connected to a front end of a lever 35a provided to one end of a drive shaft 35 through an upper end portion of a transmission link 34.

The drive shaft 35 is supported horizontally to the upper portion on the upstream side of the press body 1, and feed levers 36 are attached to both the end portions of the drive shaft 35 so that the front ends of the feed levers 36 are suspended downward, and the cross-bar carrier 9 disposed on the most upstream side is connected to the front ends of the feed levers 36 through the connection rods 9b.

The operation of the transfer feeder of this embodiment will be described hereunder.

When the upstream side slide drive mechanism 3 is driven by means of the main motor 28 through the clutch 4, the downstream side slide drive mechanism 3 connected thereto through the interlocking shaft 3a is also driven at the same time, whereby the respective slides 2 are moved vertically and the press workings are accordingly performed at the respective working stations.

Further, when the cam shaft 32a is rotated in synchronism with the operation of the press body 1 by the driving power taken out through the power take-out shaft 31, the feed cam 32 is rotated and, hence, the feed lever 36 is rotated about the driving shaft 35 through the swing lever 33 and the transmission link 34, whereby the cross-bar carriers 9 supported by the lift beam 8 are driven in the feed direction.

Then, the lift rack 12 is driven, through the speed reduction mechanism 19, by means of the servo-motor 17 of the lift drive mechanism 16 controlled in synchronism with the operation of the press body 1, and the lift beam 8 is thereby moved vertically through the respective lift rods 14. Accordingly, the cross-bars 10 horizontally mounted between the respective cross-bar carriers 9 are operated in the feed and lift directions, and the works sucked or attracted by the vacuum cup are conveyed successively to the working station.

According to this embodiment as described above in detail, since the feed drive mechanism 30 and the lift drive mechanism 16 are disposed to the upper portions of the press body 1, the power transmission line of the driving system for transmitting the driving power taken out of the slide drive mechanism 3 to the feed drive mechanism 30 can be made short.

Accordingly, the structure of the driving system can be made simple, so that any misfeed which may be caused by the vibration of the cross-bar due to the backlash of the gear can be prevented from occurring, and in addition, it is not necessary to locate any pit for accommodating the cam box to the lower portion of the press body 1, providing an advantage of cost reduction.

Further, since it is readily apparent that substantially the same effects as those of the former embodiment can be attained by the same structure as that of the former embodiment, the explanation concerning the same structure is omitted herein.

Further, the present invention has been described by way of the exemplary embodiments, and it should be readily apparent to those skilled in the art that various changes, eliminations and additions can be made without departing from the subject and scope of the present invention. Accordingly, it is to be understood that the present invention is not limited to the above embodiments and includes within its scope the elements recited in the appended claims and their equivalent scope.

We claim:

1. A transfer feeder for a module-type transfer press, wherein:

said module-type transfer press comprises a plurality of slides, a crown having a plurality of crown portions for each of the respective slides, and respective slide drive mechanisms accommodated in each of the crown portions for driving the respective slides; and said transfer feeder comprises a lift drive mechanism and a feed drive mechanism disposed in an upper portion of the transfer press, said lift drive mechanism being driven by a lift drive source, and said feed drive mechanism being accommodated in an upstream one of the crown portions which is disposed on an upstream side of the transfer press and being driven by power derived from the slide drive mechanism accommodated in said upstream one of the crown portions.

2. A transfer feeder for a module-type transfer press according to claim 1, further comprising lift beams disposed side by side in the transfer press along a work conveying direction, wherein the lift beams are driven in a lift direction by the lift drive mechanism through a plurality of lift rods arranged between the respective slides.

3. A transfer feeder for a module-type transfer press according to claim 2, wherein the lift beams are supported by the plurality of lift rods at plural support points.

4. A transfer feeder for a module-type transfer press according to claim 2, further comprising a plurality of cross-bar carriers between which cross-bars are mounted, said cross-bar carriers being supported to be movable in the work conveying direction by the lift beams and being driven in a feed direction by the feed drive mechanism through a feed lever.

5. A transfer press for a module-type transfer press according to claim 2, further comprising a servo-motor employed as a driving source of the lift drive mechanism.

6. A transfer press for a module-type transfer press according to claim 1, further comprising a servo-motor employed as a driving source of the lift drive mechanism.

* * * * *